US007604270B1

(12) United States Patent
McCarthy

(10) Patent No.: US 7,604,270 B1
(45) Date of Patent: Oct. 20, 2009

(54) CAN HOLDER SYSTEM

(76) Inventor: John J. McCarthy, 103 Village Pointe La., Asheville, NC (US) 28803

( * ) Notice: Subject to any disclaimer, the term of this patent is extended or adjusted under 35 U.S.C. 154(b) by 0 days.

(21) Appl. No.: 12/005,582

(22) Filed: Dec. 27, 2007

(51) Int. Cl.
*A47J 45/00* (2006.01)

(52) U.S. Cl. ..... 294/29; 248/312.1; 248/313; 248/311.2; 16/422; 16/425; 220/737; 220/759

(58) Field of Classification Search ..... 248/312.1; 294/29
See application file for complete search history.

(56) References Cited

U.S. PATENT DOCUMENTS 2,487,516 A * 11/1949 Braswell ..... 248/110
2,625,299 A * 1/1953 Uhlig ..... 220/736
3,189,937 A * 6/1965 Sciortino ..... 294/33
3,261,635 A * 7/1966 Talay ..... 294/29
5,913,450 A * 6/1999 Runkel ..... 220/696
6,006,966 A * 12/1999 Voisin, Jr. ..... 224/148.4
6,102,458 A * 8/2000 Scace ..... 294/34
6,658,701 B1 * 12/2003 DeHart et al. ..... 16/425

* cited by examiner

*Primary Examiner*—J. Allen Shriver, II
*Assistant Examiner*—Alaeddin Mohsen

(57) ABSTRACT

A can holder assembly has an interior section. The assembly is positionable adjacent to the side wall of a can and a laterally spaced exterior section. Lower and upper portions couple the sections. The interior portion has a vertical free edge positionable in contact with the side wall of a can. The can has upper and lower ledges. A lower retainer is fixedly coupled to the interior section beneath the lower ledge. An upper retainer is pivotally coupled to the interior section above the lower ledge. A handle has a pivot pin pivotally supported above the upper portion of the handle. The handle has inner and outer ends. The inner end supports the upper retainer. The outer end is adapted to be manipulated by a user. A spring is provided between the upper portion and the handle. The spring urges the outer end upwardly and the upper retainer downwardly.

1 Claim, 2 Drawing Sheets

FIG 1
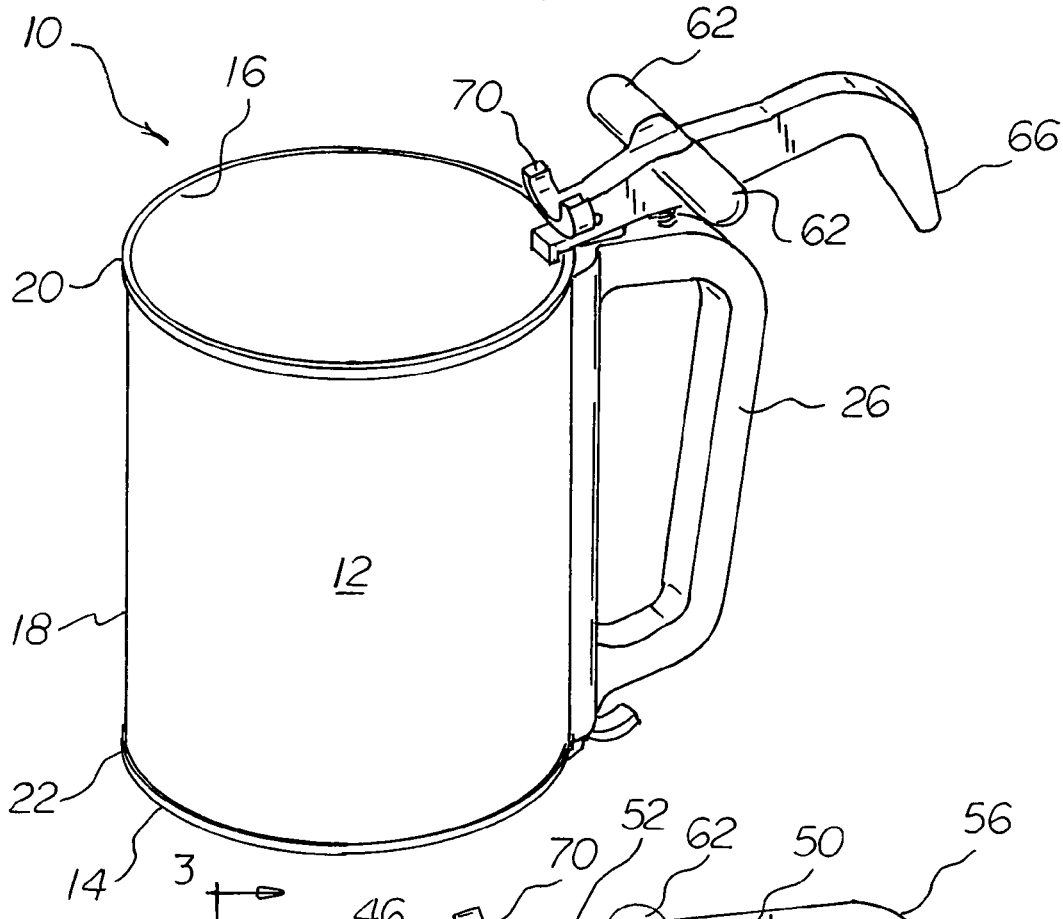
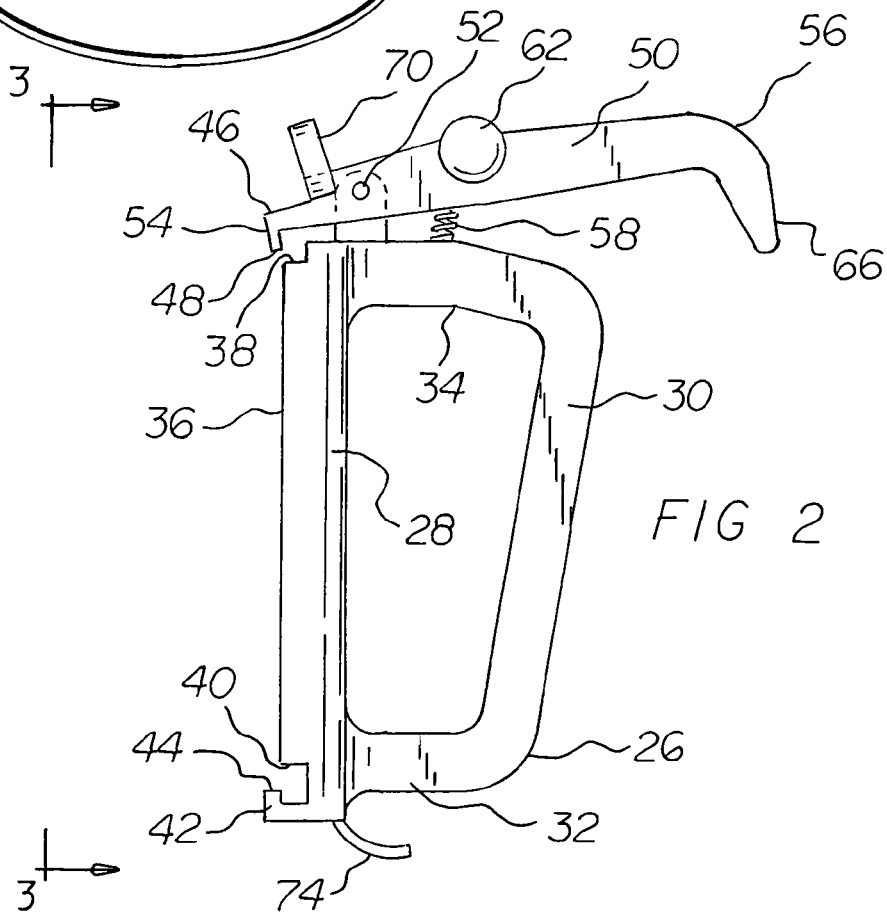
FIG 2

CAN HOLDER SYSTEM

BACKGROUND OF THE INVENTION

1. Field of the Invention

The present invention relates to a can holder systems and more particularly pertains to removably supporting a paint can and a paint brush in any plurality of ways in a safe, convenient and economical manner.

2. Description of the Prior Art

The use of holders of known designs and configurations is known in the prior art. More specifically, holders of known designs and configurations previously devised and utilized for the purpose of supporting painting tools through known methods and apparatuses are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the prior art does not describe a can holder systems that allows for removably supporting a paint can and a paint brush in any plurality of ways in a safe, convenient and economical manner.

In this respect, the can holder systems according to the present invention substantially departs from the conventional concepts and designs of the prior art, and in doing so provides an apparatus primarily developed for the purpose of removably supporting a paint can and a paint brush in any plurality of ways in a safe, convenient and economical manner.

Therefore, it can be appreciated that there exists a continuing need for a new and improved can holder systems which can be used for removably supporting a paint can and a paint brush in any plurality of ways in a safe, convenient and economical manner. In this regard, the present invention substantially fulfills this need.

SUMMARY OF THE INVENTION

In view of the foregoing disadvantages inherent in the known types of holders of known designs and configurations now present in the prior art, the present invention provides an improved can holder systems. As such, the general purpose of the present invention, which will be described subsequently in greater detail, is to provide a new and improved can holder systems and method which has all the advantages of the prior art and none of the disadvantages.

To attain this, the present invention essentially comprises a can holder systems. First provided is can. The can has a circular closed bottom. The can has a circular open top. The can has a cylindrical side wall. The side wall is provided between the top and bottom. The side wall has an upper lip. The upper lip is provided adjacent to the top. The side wall has a lower lip. The lower lip is provided adjacent to the bottom.

A can holder assembly is provided. The can holder assembly has an interior section. The interior section is positionable adjacent to the side wall of the can. The can holder assembly has an exterior section. The exterior section is laterally spaced from the side wall. In this manner the exterior section functions as a handle for a user. The can holder assembly has a short lower portion. The can holder assembly has a long upper portion. The long upper portion couples the interior and exterior sections. The interior portion has a vertical free edge. The free vertical free edge is positioned in contact with the side wall of the paint can. The interior portion has a horizontal upper ledge. The horizontal upper ledge is positioned beneath the upper lip.

The interior portion has a horizontal lower ledge. The horizontal lower ledge is positioned above the lower lip. The can holder assembly has a J-shaped lower retainer. The J-shaped lower retainer is fixedly coupled to the interior section. The J-shaped lower retainer is spaced beneath the lower ledge. The J-shaped lower retainer has free end. The free end is contact with the bottom of the paint can. The can holder assembly has a J-shaped upper retainer. The J-shaped upper retainer is pivotally coupled to the interior section spaced above the lower ledge. The J-shaped upper retainer has a free end. The free end extends downwardly over the upper lip and into the paint can.

The can holder assembly has a handle. The handle has a pivot pin. The pivot pin is pivotally supported above the long upper portion. The handle has an inner end. The inner end supports the upper retainer. The handle has an outer end. The outer end is adapted to be manipulated by a user. In this manner the upper retainer is raised and lowered. Also in this manner movement of the can holder assembly with respect to the paint can is allowed. Further in this manner the can holder assembly may be locked with respect to the paint can. A coil spring 58 is provided. The coil spring is provided between the upper portion and the handle between the pivot pin and the outer end. In this manner the outer end is urged upwardly. Further in this manner the upper retainer is urged downwardly.

Oppositely extending grips are provided. The strips extend laterally from the handle adjacent to the spring.

A leg is provided. The leg extends downwardly from the inner end of the handle. In this manner the can holder assembly is supported from a belt of a user.

Further provided is a generally U-shaped cradle. The cradle is secured to the inner end of the handle. In this manner a support is provided for a paint brush.

Provided last is a rigid metal arcuate member. The arcuate member is secured to the interior section beneath the lower retainer member. The arcuate member is adapted to function as a can opener.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved can holder systems which has all of the advantages of the prior art holders of known designs and configurations and none of the disadvantages.

It is another object of the present invention to provide a new and improved can holder systems which may be easily and efficiently manufactured and marketed.

It is further object of the present invention to provide a new and improved can holder systems which is of durable and reliable constructions.

An even further object of the present invention is to provide a new and improved can holder systems which is susceptible of a low cost of manufacture with regard to both materials and labor, and which accordingly is then susceptible of low prices of sale to the consuming public, thereby making such can holder systems economically available to the buying public.

Even still another object of the present invention is to provide a can holder systems for removably supporting a paint can and a paint brush in any plurality of ways in a safe, convenient and economical manner.

Lastly, it is an object of the present invention to provide a new and improved can holder systems. A can holder assembly has an interior section. The assembly is positionable adjacent to the side wall of a can and a laterally spaced exterior section. Lower and upper portions couple the sections. The interior portion has a vertical free edge positionable in contact with the side wall of a can. The can has upper and lower ledges. A lower retainer is fixedly coupled to the interior section beneath the lower ledge. An upper retainer is pivotally coupled to the interior section above the lower ledge. A handle has a pivot pin pivotally supported above the upper portion of the handle. The handle has inner and outer ends. The inner end supports the upper retainer. The outer end is adapted to be manipulated by a user. A spring is provided between the upper portion and the handle. The spring urges the outer end upwardly and the upper retainer downwardly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a can holder system constructed in accordance with the principles of the present invention.

FIG. 2 is a side elevational view of the can holder assembly of FIG. 1.

The same reference numerals refer to the same parts throughout the various Figures.

DESCRIPTION OF THE PREFERRED EMBODIMENT

Figure 3:
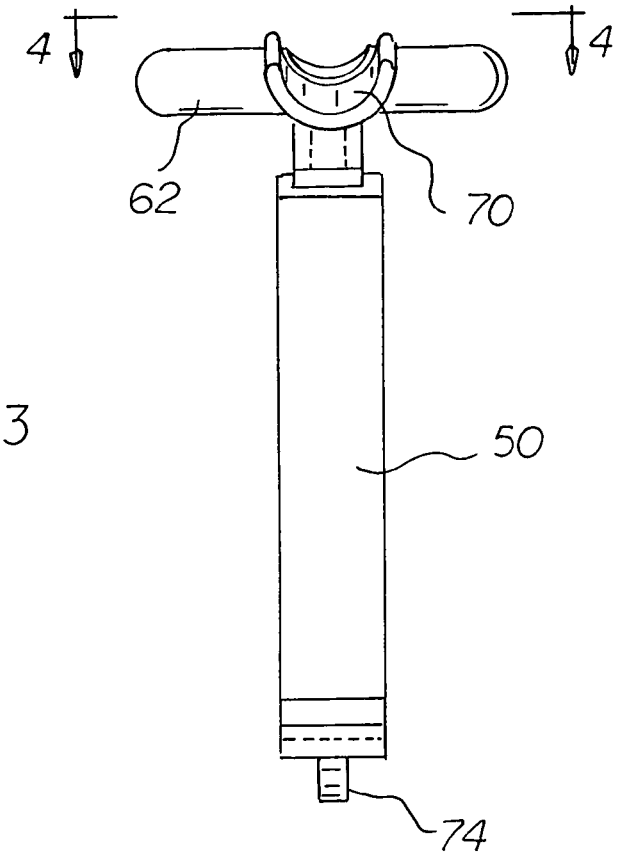
FIG. 3 is a front elevational view of the can holder assembly taken along line 3-3 of FIG. 2.
Figure 4:
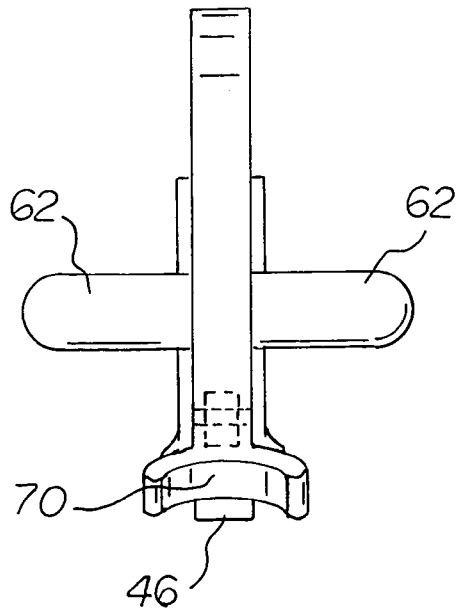
FIG. 4 is a plan view of the can holder assembly taken along line 4-4 of FIG. 3.

With reference now to the drawings, and in particular to FIG. 1 thereof, the preferred embodiment of the new and improved can holder systems embodying the principles and concepts of the present invention and generally designated by the reference numeral 10 will be described.

The present invention, the can holder systems 10 is comprised of a can holder assembly. The can holder assembly, in is broadest context is configured so as to attain the desired objective.

First provided is can 12. The can has a circular closed bottom 14. The can has a circular open top 16. The can has a cylindrical side wall 18. The side wall is provided between the top and bottom. The side wall has an upper lip 20. The upper lip is provided adjacent to the top. The side wall has a lower lip 22. The lower lip is provided adjacent to the bottom.

A can holder assembly 26 is provided. The can holder assembly has an interior section 28. The interior section is positionable adjacent to the side wall of the can. The can holder assembly has an exterior section 30. The exterior section is laterally spaced from the side wall. In this manner the exterior section functions as a handle for a user. The can holder assembly has a short lower portion 32. The can holder assembly has a long upper portion 34. The long upper portion couples the interior and exterior sections. The interior portion has a vertical free edge 36. The free vertical free edge is positioned in contact with the side wall of the paint can.

The interior portion has a horizontal upper ledge 38. The horizontal upper ledge is positioned beneath the upper lip. The interior portion has a horizontal lower ledge 40. The horizontal lower ledge is positioned above the lower lip. The can holder assembly has a J-shaped lower retainer 42. The J-shaped lower retainer is fixedly coupled to the interior section. The J-shaped lower retainer is spaced beneath the lower ledge. The J-shaped lower retainer has free end 44. The free end is contact with the bottom of the paint can. The can holder assembly has a J-shaped upper retainer 46. The J-shaped upper retainer is pivotally coupled to the interior section spaced above the lower ledge. The J-shaped upper retainer has a free end 48. The free end extends downwardly over the upper lip and into the paint can.

The can holder assembly has a handle 50. The handle has a pivot pin 52. The pivot pin is pivotally supported above the long upper portion. The handle has an inner end 54. The inner end supports the upper retainer. The handle has an outer end 56. The outer end is adapted to be manipulated by a user. In this manner the upper retainer is raised and lowered. Also in this manner movement of the can holder assembly with respect to the paint can is allowed. Further in this manner the can holder assembly may be locked with respect to the paint can. A coil spring 58 is provided. The coil spring is provided between the upper portion and the handle between the pivot pin and the outer end. In this manner the outer end is urged upwardly. Further in this manner the upper retainer is urged downwardly.

Oppositely extending grips 62 are provided. The strips extend laterally from the handle adjacent to the spring.

A leg 66 is provided. The leg extends downwardly from the inner end of the handle. In this manner the can holder assembly is supported from a belt of a user.

Further provided is a generally U-shaped cradle 70. The cradle is secured to the inner end of the handle. In this manner a support is provided for a paint brush.

Provided last is a rigid metal arcuate member 74. The arcuate member is secured to the interior section beneath the lower retainer member. The arcuate member is adapted to function as a can opener.

The system of the present invention is adapted for use with any sized can, quart or gallon or any other size. It is adapted for use by painters, roofers, carpet installers, tile installers, linoleum installers and many others, professionals and first time users. It is also handicap friendly. Preferably fabricated of polyvinyl chloride, PVC, with a metal can opener, the system is readily available in any color and is lightweight, versatile, reusable, durable, all for long time use. Engineered with a ladder/belt hook, it frees up both hands and includes five different handles to create comfort in all day projects.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can holder system for removably supporting a paint can and a paint brush in any of a plurality of ways in a safe, convenient and economical manner comprising, in combination:

a can having a circular closed bottom and a circular open top with a cylindrical side wall between the top and bottom, the side wall having an upper lip adjacent to the top and a lower lip adjacent to the bottom;

a can holder assembly having an interior section positionable adjacent to the side wall of the can and an exterior section laterally spaced from the side wall to function as a handle for a user and with a short lower portion and a long upper portion coupling the interior and exterior sections, the interior portion having a vertical free edge positioned in contact with the side wall of the paint can with a horizontal upper ledge positioned beneath the upper lip and a horizontal lower ledge positioned above the lower lip, a J-shaped lower retainer fixedly coupled to the interior section spaced beneath the lower ledge with a free end in contact with the bottom of the paint can, a J-shaped upper retainer pivotally coupled to the interior section spaced above the lower ledge with a free end extending downwardly over the upper lip and into the paint can, a handle with a pivot pin pivotally supported above the long upper portion with the handle having an inner end supporting the upper retainer and an outer end adapted to be manipulated by a user to raise the upper retainer and allow movement of the can holder assembly with respect to the paint can and to lower the upper retainer to lock the can holder assembly with respect to the paint can, the distance between the pivot pin and the inner end of the handle being less than the distance between the pivot pin and the outer end of the handle, a coil spring between the upper portion and the handle between the pivot pin and the outer end urging the outer end upwardly and urging the upper retainer downwardly;

oppositely extending grips extending laterally from the handle adjacent to the spring;

a leg extending downwardly from the inner end of the handle laterally spaced from the interior section of the can holder assembly for supporting the can holder assembly from a belt of a user;

a generally U-shaped cradle secured to the inner end of the handle above the upper lip of the can to provide a support for a paint brush; and a rigid metal arcuate member secured to the interior section beneath the lower retainer member adapted to function as a can opener.

* * * * *